US010898019B2

(12) United States Patent
Baines et al.

(10) Patent No.: US 10,898,019 B2
(45) Date of Patent: Jan. 26, 2021

(54) ADJUSTABLE OVER-THE-DOOR HOOKS AND RACKS

(71) Applicant: Decolin Inc., Montreal (CA)

(72) Inventors: David M. Baines, Bedford, NY (US); Benjamin Scanlon, Philadelphia, PA (US); Adam Thomas Emenecker, Blackwood, NJ (US)

(73) Assignee: Decolin Inc.

( * ) Notice: Subject to any disclaimer, the term of this patent is extended or adjusted under 35 U.S.C. 154(b) by 0 days.

(21) Appl. No.: 16/154,921

(22) Filed: Oct. 9, 2018

(65) Prior Publication Data

US 2019/0104874 A1 Apr. 11, 2019

Related U.S. Application Data

(60) Provisional application No. 62/570,306, filed on Oct. 10, 2017.

(51) Int. Cl.

| | |
|---|---|
| ***A47B 96/00*** | (2006.01) |
| ***A47K 1/00*** | (2006.01) |
| ***A47G 25/06*** | (2006.01) |

(52) U.S. Cl.
CPC ..... *A47G 25/0614* (2013.01)

(58) Field of Classification Search
CPC ..... A47H 27/00; A47G 25/0614; A47B 96/16
See application file for complete search history.

(56) References Cited

U.S. PATENT DOCUMENTS

| | | | | |
|---|---|---|---|---|
| 1,474,660 | A | | 11/1923 | White |
| 1,540,556 | A | | 6/1925 | Laurie |
| 2,534,067 | A | * | 12/1950 | Rubin ..... A63B 63/083 473/487 |
| 2,743,023 | A | | 4/1956 | Larson |
| 3,536,286 | A | | 10/1970 | Kramer |
| 3,891,176 | A | | 6/1975 | Downing et al. |
| 3,907,118 | A | * | 9/1975 | Pelavin ..... A47G 25/0614 211/113 |
| 4,034,865 | A | | 7/1977 | Batts et al. |
| 4,059,248 | A | * | 11/1977 | Kuntz ..... A47H 27/00 248/214 |
| 4,387,873 | A | | 6/1983 | Pavlo et al. |
| 4,709,891 | A | | 12/1987 | Barnett |
| 4,817,239 | A | | 4/1989 | Campbell et al. |
| D305,299 | S | | 1/1990 | Freeman |
| 5,087,007 | A | | 2/1992 | Gaderick |
| D326,021 | S | | 5/1992 | Evenson |
| D340,672 | S | | 10/1993 | Adams |

(Continued)

OTHER PUBLICATIONS

The International Search Report and the Written Opinion of the International Searching Authority for International Application No. PCT/CA2018/051267, 12 pages.

*Primary Examiner* — Amy J. Sterling

(74) *Attorney, Agent, or Firm* — Alan G. Towner; Leech Tishman Fuscaldo & Lampl

(57) ABSTRACT

Adjustable over-the-door hook assemblies with removable door spacers that accommodate different door thicknesses and different types of doors are disclosed. The door spacer may be selectively mounted on a support bracket, or may be removed from the bracket for use with thicker doors. A door bumper may also be provided on a lower portion of the hook assembly to vertically align the assembly and to prevent damage to the door.

5 Claims, 12 Drawing Sheets

(56) References Cited

U.S. PATENT DOCUMENTS

| | | | | |
|---|---|---|---|---|
| D342,889 | S | 1/1994 | Adams | |
| 5,413,297 | A | 5/1995 | Adams | |
| 5,515,981 | A | 5/1996 | Gregory et al. | |
| 5,535,971 | A | 7/1996 | Adams | |
| 5,553,823 | A | 9/1996 | Protz, Jr. | |
| D374,168 | S | 10/1996 | Protz, Jr. | |
| 5,875,902 | A * | 3/1999 | Emery | A47B 96/16 108/29 |
| D422,198 | S | 4/2000 | Snell | |
| 6,224,030 | B1 | 5/2001 | Hepworth | |
| 6,302,365 | B1 | 10/2001 | Catanzarite et al. | |
| 6,311,851 | B1 | 11/2001 | Knudsen, Sr. et al. | |
| D455,947 | S | 4/2002 | Goodman et al. | |
| D479,918 | S | 9/2003 | Mink | |
| D479,981 | S | 9/2003 | Snell | |
| 7,207,088 | B2 | 4/2007 | Adams et al. | |
| 7,887,017 | B2 | 2/2011 | Moran | |
| 7,992,833 | B1 * | 8/2011 | Goodman | A47G 25/0614 248/298.1 |
| 9,736,992 | B1 * | 8/2017 | Barry | A01G 5/04 |
| 2002/0144962 | A1 | 10/2002 | Dettorre et al. | |

* cited by examiner 30
38
32
35
33
47
34
36
13
40
43
44

10
12
24
20
15
18
26
14
50
22
16
17

30
38
40
10
34
41
49
35
32
42
36
12
24
20
15
19
26
18
16
22
50
14
17

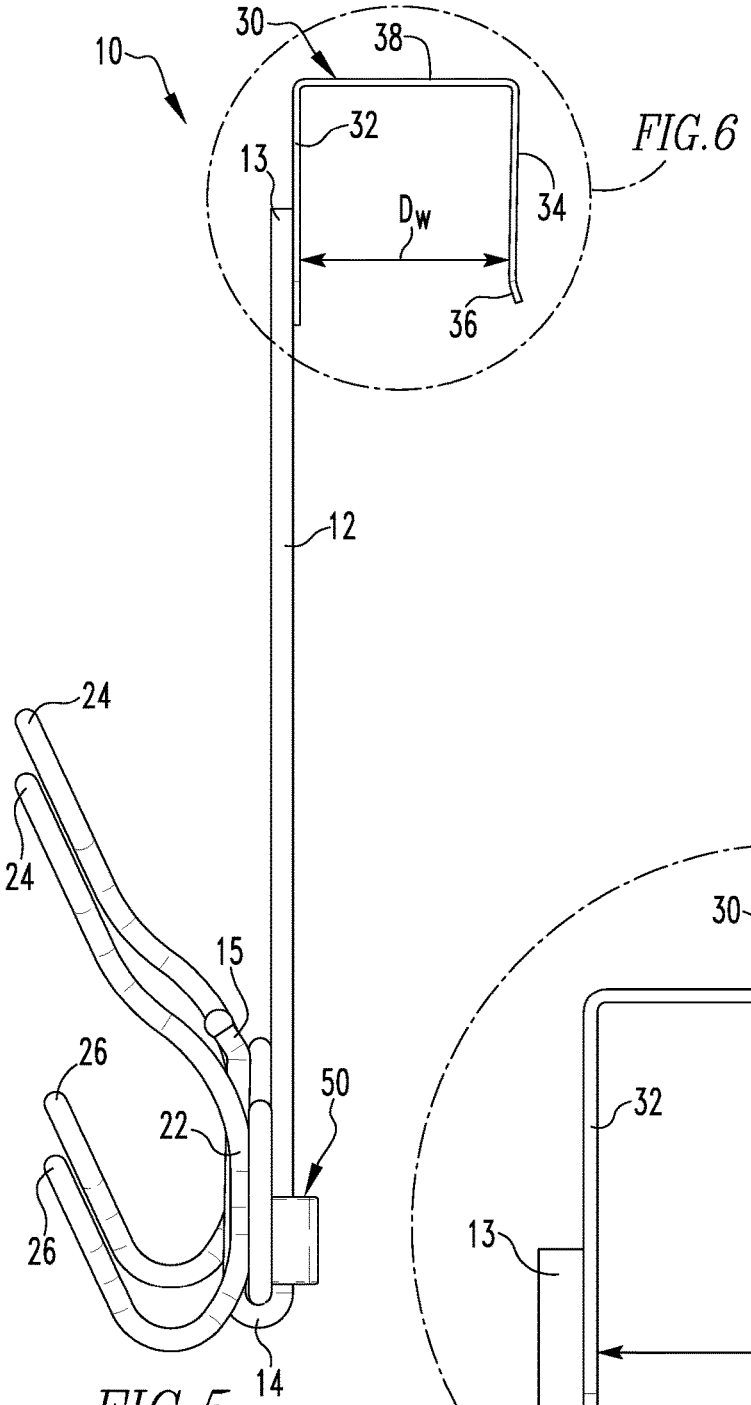
FIG.6
FIG.5
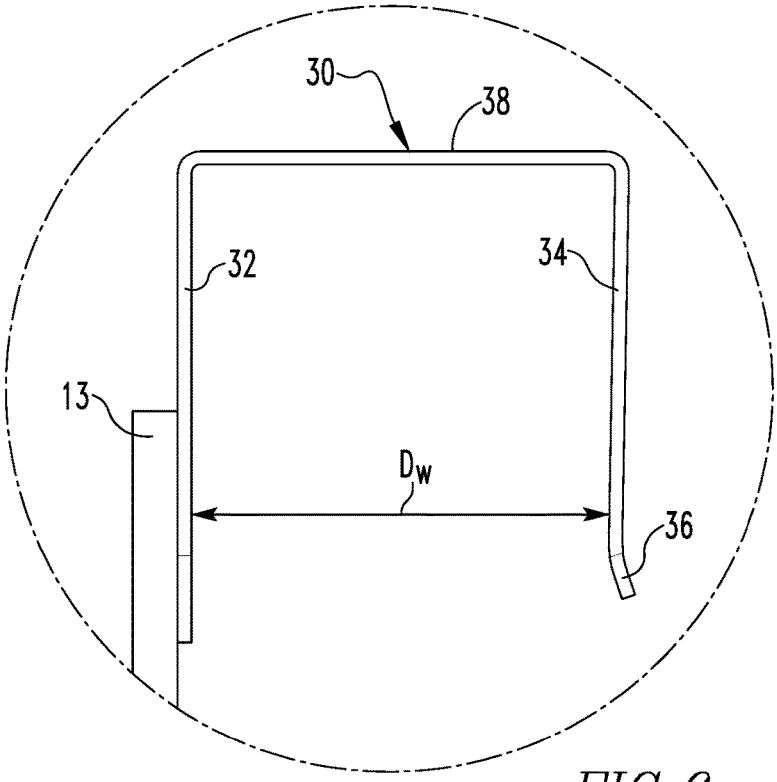
FIG.6

ADJUSTABLE OVER-THE-DOOR HOOKS AND RACKS

CROSS-REFERENCE TO RELATED APPLICATION

This application claims priority from U.S. Provisional Application No. 62/570,306 filed Oct. 10, 2017, which is incorporated herein by reference.

FIELD OF THE INVENTION

The present invention relates to door hooks and racks, and more particularly relates to over-the-door hooks and racks that are adjustable to fit varying door thicknesses.

BACKGROUND INFORMATION

In the United States there are generally two standard door widths, 1¾ inches and 1⅜ inches. Conventional over-the-door hooks are made to accommodate the thicker doors. In doing so, the fit on the thinner doors is poor. The use of a metal piece that is fastened by a screw has been proposed, but a need exists for an over-the-door hook that is simple and easy to re-adjust to different configurations for different types of doors.

SUMMARY OF THE INVENTION

The present invention provides adjustable over-the-door hook assemblies with removable door spacers that accommodate different door thicknesses and different types of doors. The door spacer may be selectively mounted on a support bracket, or may be removed from the bracket for use with thicker doors. A door bumper may also be provided on a lower portion of the hook assembly to vertically align the assembly and to prevent damage to the door.

An aspect of the present invention is to provide an adjustable over-the-door hook assembly comprising: at least one adjustable support bracket structured and arranged for placement over a top edge of a door comprising front and rear vertical plates having opposing interior surfaces, and an upper horizontal plate connecting the front and rear vertical plates, at least one vertical support rod attached to the at least one adjustable support bracket, at least one hook or rod supported by the at least one vertical support rod, and a removable door spacer selectively attachable adjacent to either the interior surface of the front vertical plate or the interior surface of the rear vertical plate.

Another aspect of the present invention is to provide an adjustable over-the-door hook assembly comprising: at least one adjustable support bracket structured and arranged for placement over a top edge of a door comprising front and rear vertical plates having opposing interior surfaces, and an upper horizontal plate connecting the front and rear vertical plates, at least one vertical support rod attached to the at least one adjustable support bracket, at least one hook or rod supported by the at least one vertical support rod, and a door spacer removably attachable to the at least one adjustable support bracket comprising a vertical door contact surface and an opposing bracket contact surface having a mounting pin extending therefrom structured and arranged to extend through a hole in the adjustable support bracket to thereby removably attach the door spacer to the adjustable support bracket.

These and other aspects of the present invention will be more apparent from the following description.

BRIEF DESCRIPTION OF THE DRAWINGS

FIG. 5 is a side view of an adjustable over-the-door hook assembly in accordance with an embodiment of the present invention.

FIG. 6 is a magnified view of a portion of FIG. 5 illustrating details of an adjustable support bracket in accordance with an embodiment of the present invention.

DETAILED DESCRIPTION

Figures 1, 2:
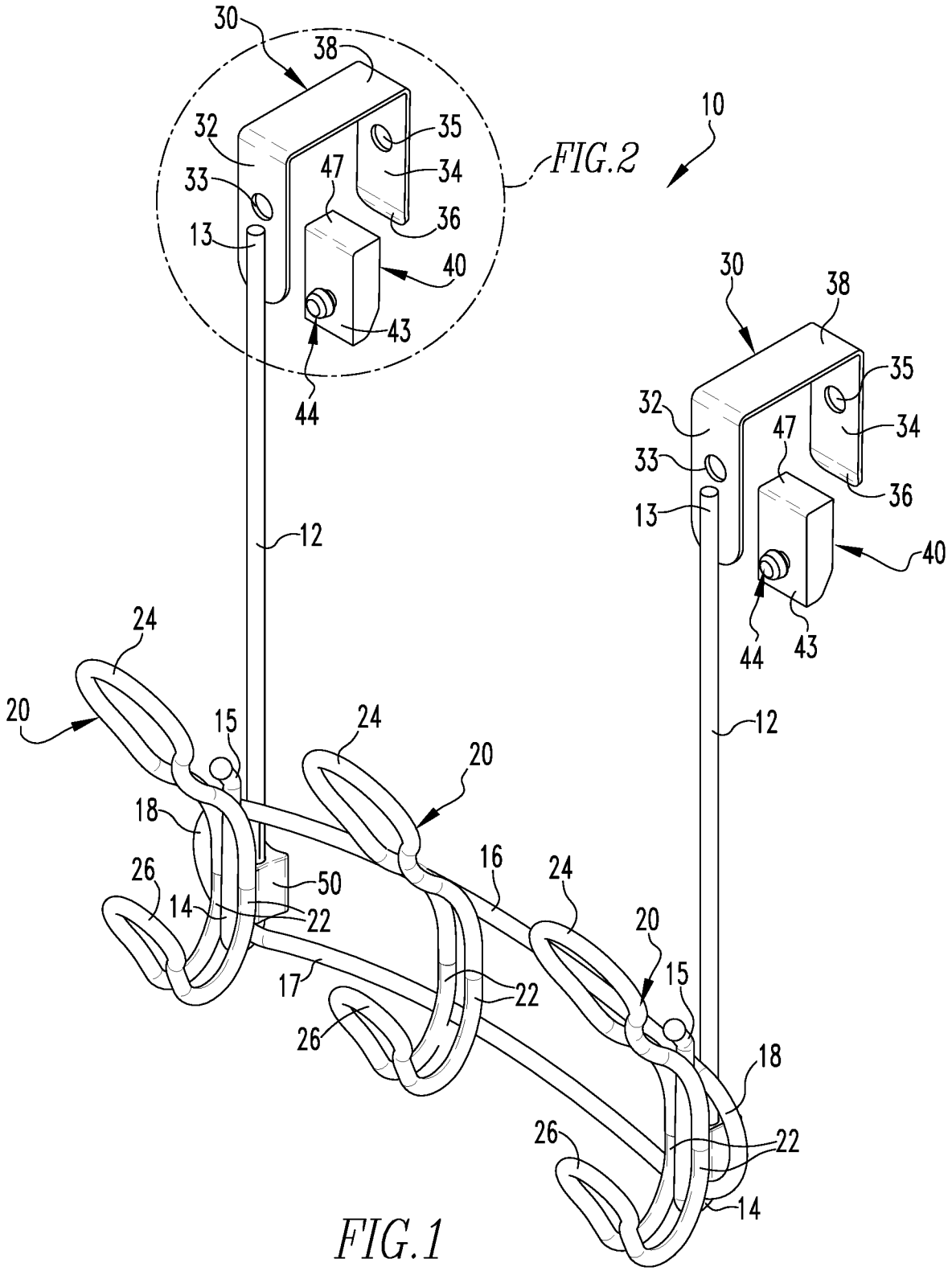
FIG. 1 is a front isometric view of an adjustable over-the-door hook assembly in accordance with an embodiment of the present invention.
FIG. 2 is a magnified view of a portion of FIG. 1 illustrating details of a door spacer in accordance with an embodiment of the present invention.
Figure 2:
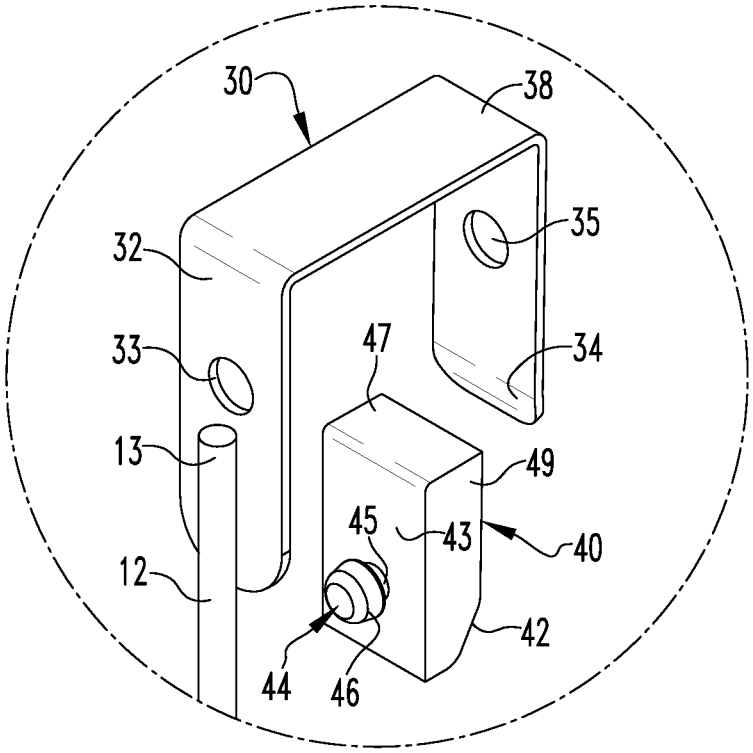

FIGS. 1-10 illustrate an adjustable over-the-door hook assembly 10 in accordance with an embodiment of the present invention. As used herein, the term "hook assembly" includes assemblies including one or more hooks, e.g., for hanging clothes, towels and the like, and assemblies including one or more racks or rods, e.g., for holding bath towels, hand towels and the like. The over-the-door hook assembly 10 includes two vertical support rods 12, each of which has an upper end 13 and a lower end 14. An upper lateral support rod 16 and a lower lateral support rod 17 are attached near the lower ends 14 of the vertical support rods 12. In the embodiment shown, side ends 18 are integrally formed with the upper and lower lateral support rods 16 and 17 to provide a continuous loop. Alternatively, the upper and lower lateral support rods 16 and 17 may have ends that are welded or otherwise directly attached to the vertical support rods 12 without the use of the side ends 18.

Figures 3, 4:
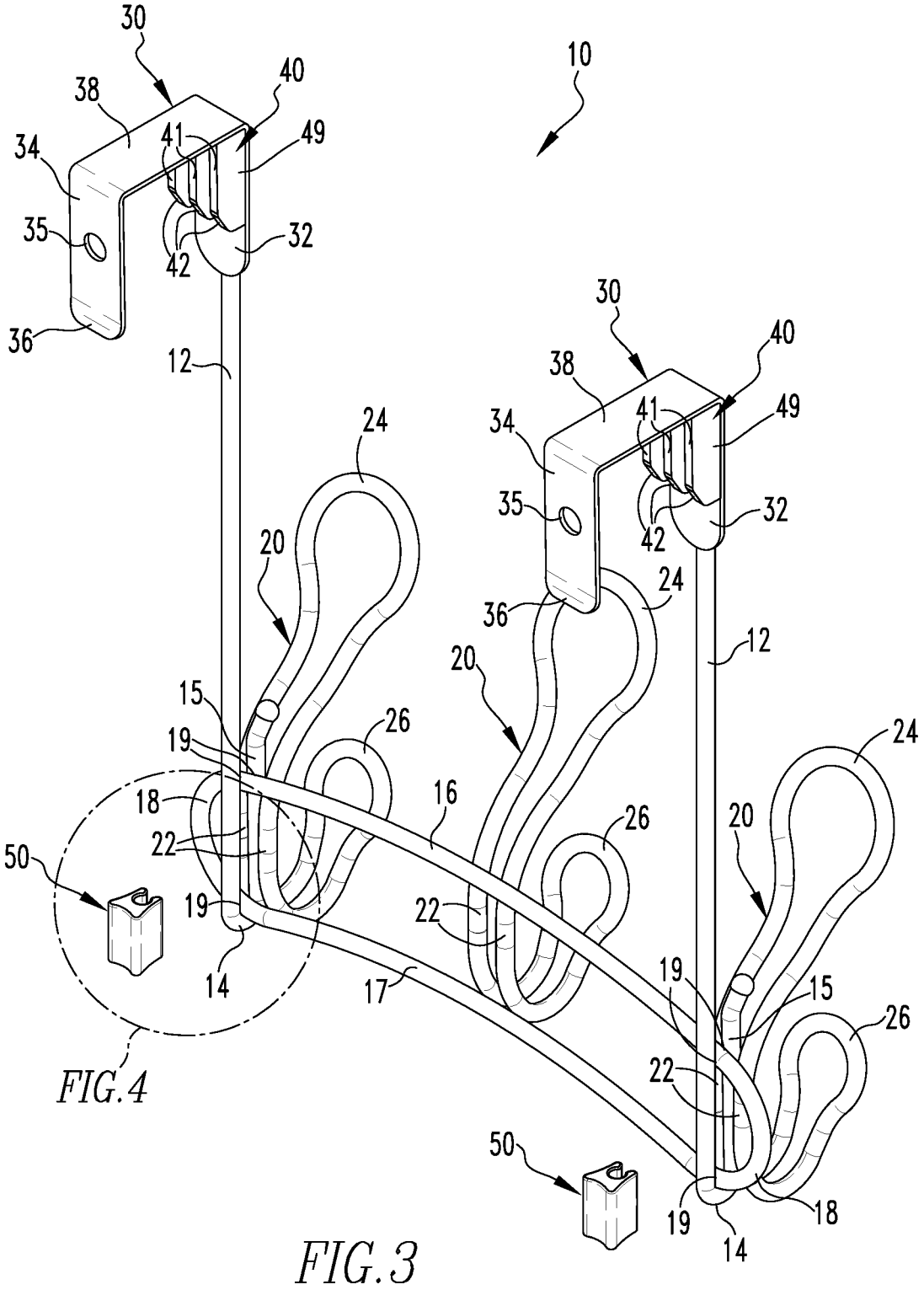
FIG. 3 is rear isometric view of an adjustable over-the-door hook assembly in accordance with an embodiment of the present invention.
FIG. 4 is magnified view of a portion of FIG. 3 illustrating details of a door bumper in accordance with an embodiment of the present invention.
Figure 4:
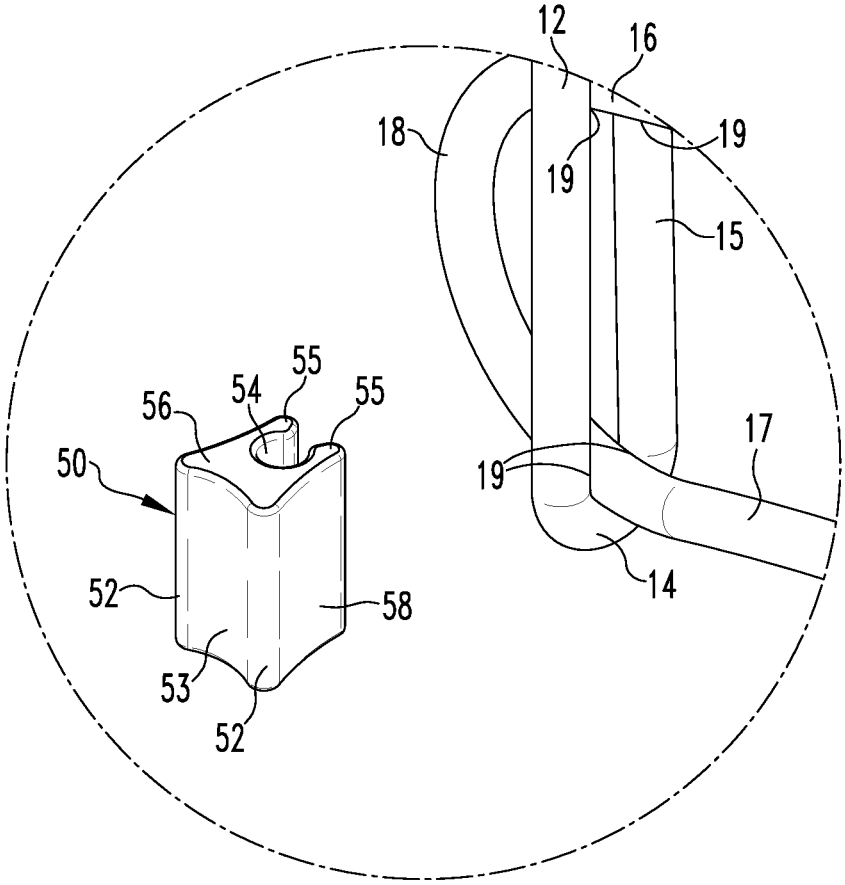

As shown most clearly in FIGS. 3 and 4, the lower end 14 of each vertical support rod 12 may wrap around the lower lateral rod 17 and may include an upward extension 15 to provide a cradle that helps support the lower lateral support rod 17. In the embodiment shown, the upward extension 15 also contacts the upper lateral support rod 16. Multiple contact points 19 are thus provided between the vertical support rods 12 and the upper and lower lateral support rods 16 and 17. In the embodiment shown, the contact points 19 include a U-shaped line of contact where the lower end 14 of each vertical support rod 12 wraps around the lower lateral support rod 17, as well as four additional contact points where the vertical support rods 12 and upward extensions 15 engage the upper lateral support rod 16. In certain embodiments, some or all of the contact points may include welds or other means of attachment between the rods such as mechanical fasteners, brackets, clips or adhesives.

As shown most clearly in FIGS. 1, 3, 5, 7 and 9, the adjustable over-the-door hook assembly 10 includes multiple hooks 20. Although three hooks 20 are shown in the figures, it is to be understood that any other suitable number of hooks may be used, such as one, two, four, or more hooks. Each hook 20 includes a back support portion 22, an upper hook loop 24, and a lower hook loop 26. In the embodiment shown, the hooks 20 are formed from a continuous loop of material. However, any other suitable hook configuration may be used. The hooks 20 may be connected to the upper and lower lateral support rods 16 and 17 by any suitable means such as welding, brackets, clips, mechanical fasteners, adhesives and the like.

As shown most clearly in FIGS. 1-3 and 5-10, an adjustable support bracket 30 is provided adjacent to the upper end 13 of each vertical support rod 12. The adjustable support bracket 30 is structured and arranged to fit over the top edge of various sized doors, and includes a front vertical plate 32, a rear vertical plate 34, and an upper horizontal plate 38. The front and rear vertical plates 32 and 34 have opposing interior surfaces for receiving the top edges of various sized doors therebetween. As shown most clearly in FIGS. 1-3, a front spacer mounting hole 33 is provided through the front vertical plate 32, and a rear spacer mounting hole 35 is provided through the rear vertical plate 34. The rear vertical plate 34 includes a bottom angled end 36 which facilitates placement of the adjustable support bracket 30 over the top edge of a door (not shown).

As shown most clearly in FIGS. 1-3, 8, 10 and 11, a door spacer 40 is removably mountable on the adjustable support bracket 30. In the embodiment shown, the door spacer 40 is mountable on either the front vertical plate 32 or the rear vertical plate 34 of the adjustable support bracket 30.

As shown in FIGS. 1-3, 11 and 12, the door spacer 40 includes a vertical door contact surface 41 with an angled lower portion 42 at a lower end thereof. In the embodiment shown, the door contact surface 41 includes a series of three vertical ribs, as shown most clearly in FIG. 12. Such ribs allow the door spacer 40 to be compressed more easily when the assembly is placed on a door in comparison with a solid door spacer having a continuous flat door contact surface. However, any other suitable number of ribs, or a flat, concave or convex surface, may be used as the door contact surface. The door spacer 40 also includes a bracket contact surface 43 with a mounting pin 44 extending therefrom. The mounting pin 44 includes a generally cylindrical shaft 45 and a retaining head 46 having a greater diameter than the shaft 45. The door spacer 40 includes a top surface 47, a bottom surface 48, and side surfaces 49.

Figures 7, 8:
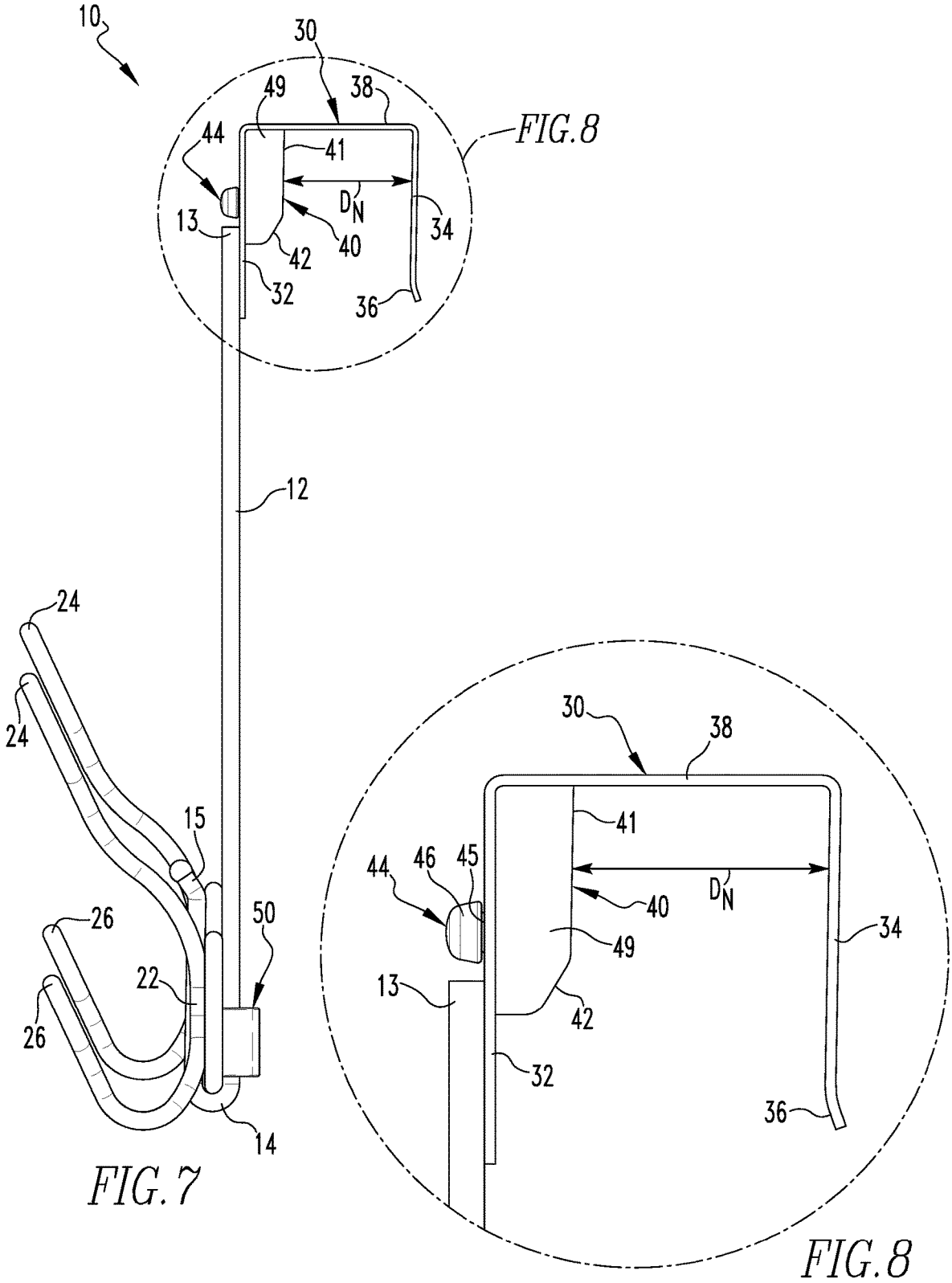
FIG. 7 is a side view of an adjustable over-the-door hook assembly in accordance with an embodiment of the present invention.
FIG. 8 is a magnified view of a portion of FIG. 7 illustrating details of an adjustable support bracket in accordance with an embodiment of the present invention.
Figures 9, 10:
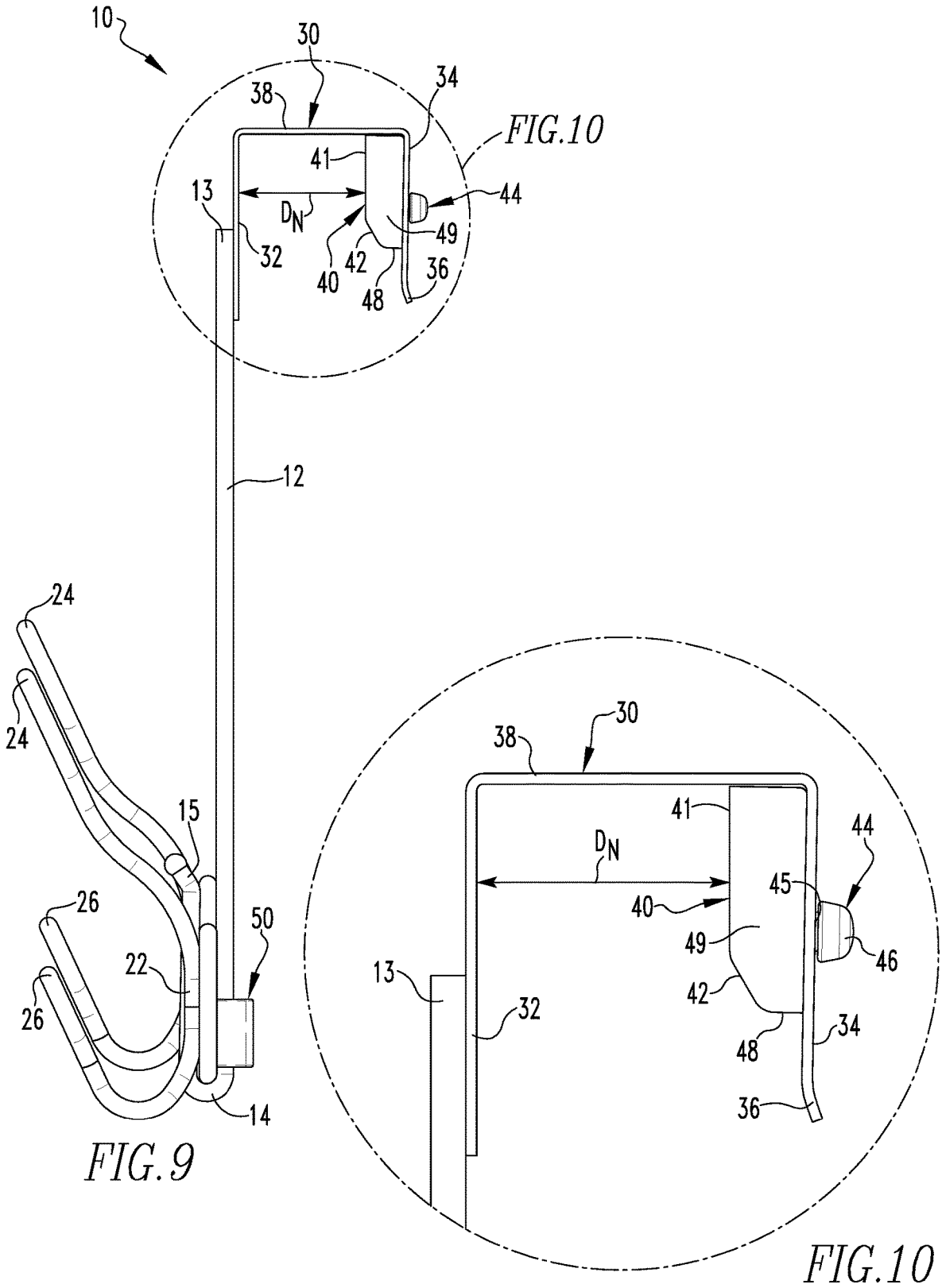
FIG. 9 is a side view of an adjustable over-the-door hook assembly in accordance with an embodiment of the present invention.
FIG. 10 is a magnified view of a portion of FIG. 9 illustrating details of an adjustable support bracket in accordance with an embodiment of the present invention.
Figure 11:
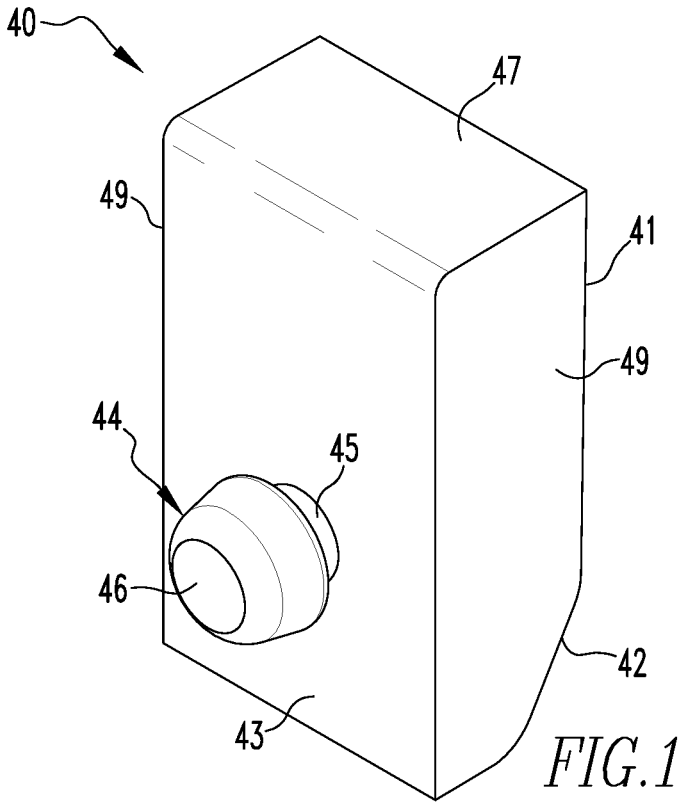
FIG. 11 is a rear isometric view of a door spacer for use in an adjustable over-the-door hook assembly in accordance with an embodiment of the present invention.
Figure 12:
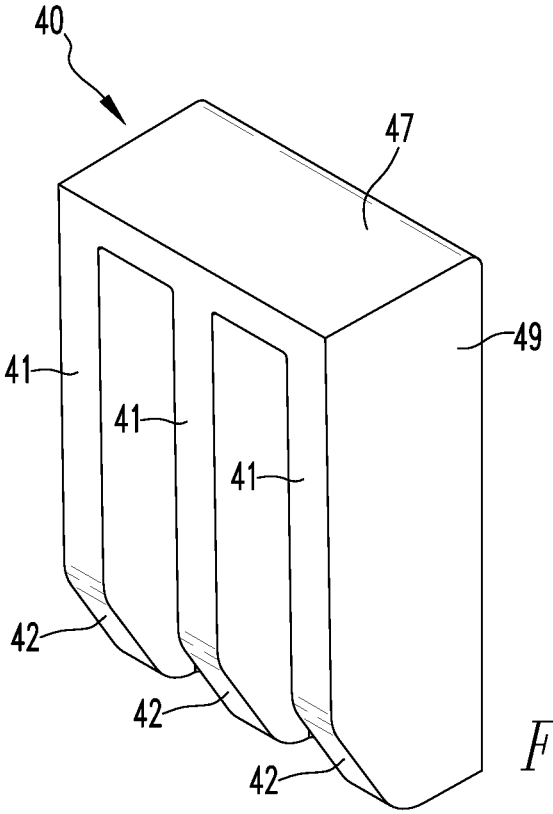
FIG. 12 is a front isometric view of the door spacer of FIG. 11.

As shown in FIGS. 5 and 6, the door spacer 40 may be removed from the adjustable support bracket 30. As shown in FIGS. 7 and 8, the door spacer 40 may be installed on the front vertical plate 32 of the adjustable support bracket 30. As shown in FIGS. 9 and 10, the door spacer 40 may be installed on the rear vertical plate 34. When the door spacer 40 is removed, the distance between the opposing interior surfaces of the front and rear vertical plates 32 and 34 is labeled as $D_W$ in FIG. 6. In this configuration, the relatively wide distance $D_W$ is selected to snuggly fit over a relatively wide door, e.g., a door having a thickness of 1.75 inches. When the door spacer 40 is mounted on the front vertical plate 32 as shown in FIG. 8, the distance between the vertical door contact surface 41 of the spacer 40 and the interior surface of the rear vertical plate 34 is labeled as $D_N$. Similarly, when the door spacer 40 is mounted on the rear vertical plate 34 of the adjustable support bracket 30, the distance between the vertical door contact surface 41 of the spacer 40 and the interior surface of the front vertical plate 32 is labeled as $D_N$. In the configurations shown in FIGS. 7-10, the relatively narrow distance $D_N$ is selected to snuggly fit over a relatively narrow door, e.g., a door having a thickness of 1.375 inches. When the door spacer 40 is made of a compressible elastic material, the distance $D_N$ may be less than 1.375 inches, for example, from 1.25 to 1.37 inches, or from 1.29 to 1.35 inches.

The thickness of the door spacer 40, measured between its door contact surface 41 and bracket contact surface 43, may typically range from 0.3 to 0.5 inch, or from 0.37 to 0.45 inch. For example, the thickness may be about 0.375 inch. In certain embodiments, the thickness may be greater than 0.375 inch, for example, from 0.38 to 0.48 inch, from 0.40 to 0.46 inch, or from 0.42 to 0.44 inch. Selective placement of the door spacer 40 on either the front or rear vertical plates 32 and 34, or removal of the door spacer from the assembly, provides simple hand adjustment of the spacer bracket 30 to accommodate different door thicknesses and different door types or styles, without the necessity of tools.

Figure 13:
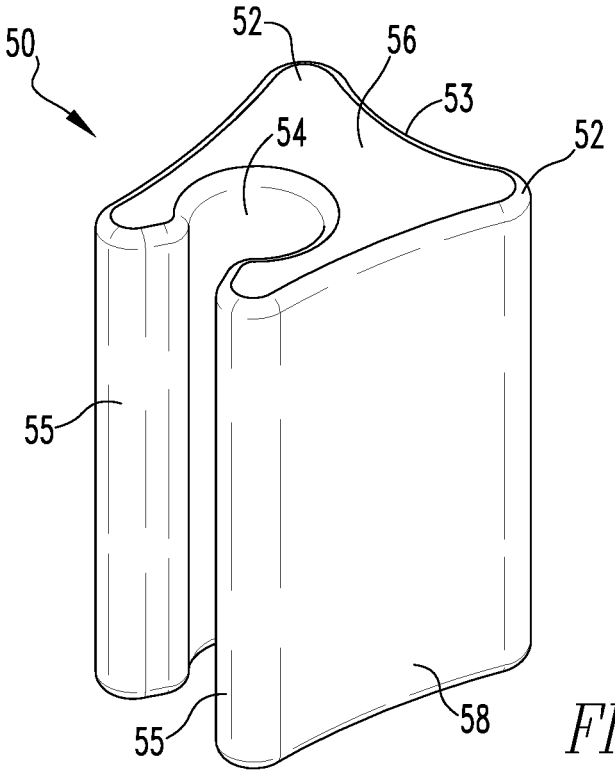
FIG. 13 is an isometric view of a door bumper for use in an adjustable over-the-door hook assembly in accordance with an embodiment of the present invention.

As shown most clearly in FIGS. 3, 4 and 13, a door bumper 50 may be removably mounted on the lower end 14 of each vertical support rod 12. In the embodiment shown, each door bumper 50 is mounted on a vertical support rod 12 between the upper and lower lateral support rods 16 and 17, which help retain the door bumper 50 at a desired location along the length of each vertical support rod 12.

As shown most clearly in FIGS. 4 and 13, the door bumper 50 includes vertical side contact ribs 52 and a concave surface 53 between the side contact ribs 52. A vertical support rod-receiving channel 54 is provided in the door bumper 50. The rod-receiving channel 54 includes opposing resilient ribs 55. The door bumper 50 includes a top surface 56, a bottom surface 57, and side surfaces 58. The door bumpers 50 may be used to help space the vertical support rods 12 away from a door in order to prevent unwanted contact and potential damage of the door surface by the vertical support rods 12. In addition, the door bumpers 50 may be used to vertically align the vertical support rods 1 with the surface of the door.

The components of the adjustable over-the-door hook assembly 10 may be made from any suitable materials known to those skilled in the art, such as metal and/or plastic for the support rod and hook components, and natural rubber, synthetic rubber or resilient polymers for the spacer and bumper components.

Figure 14:
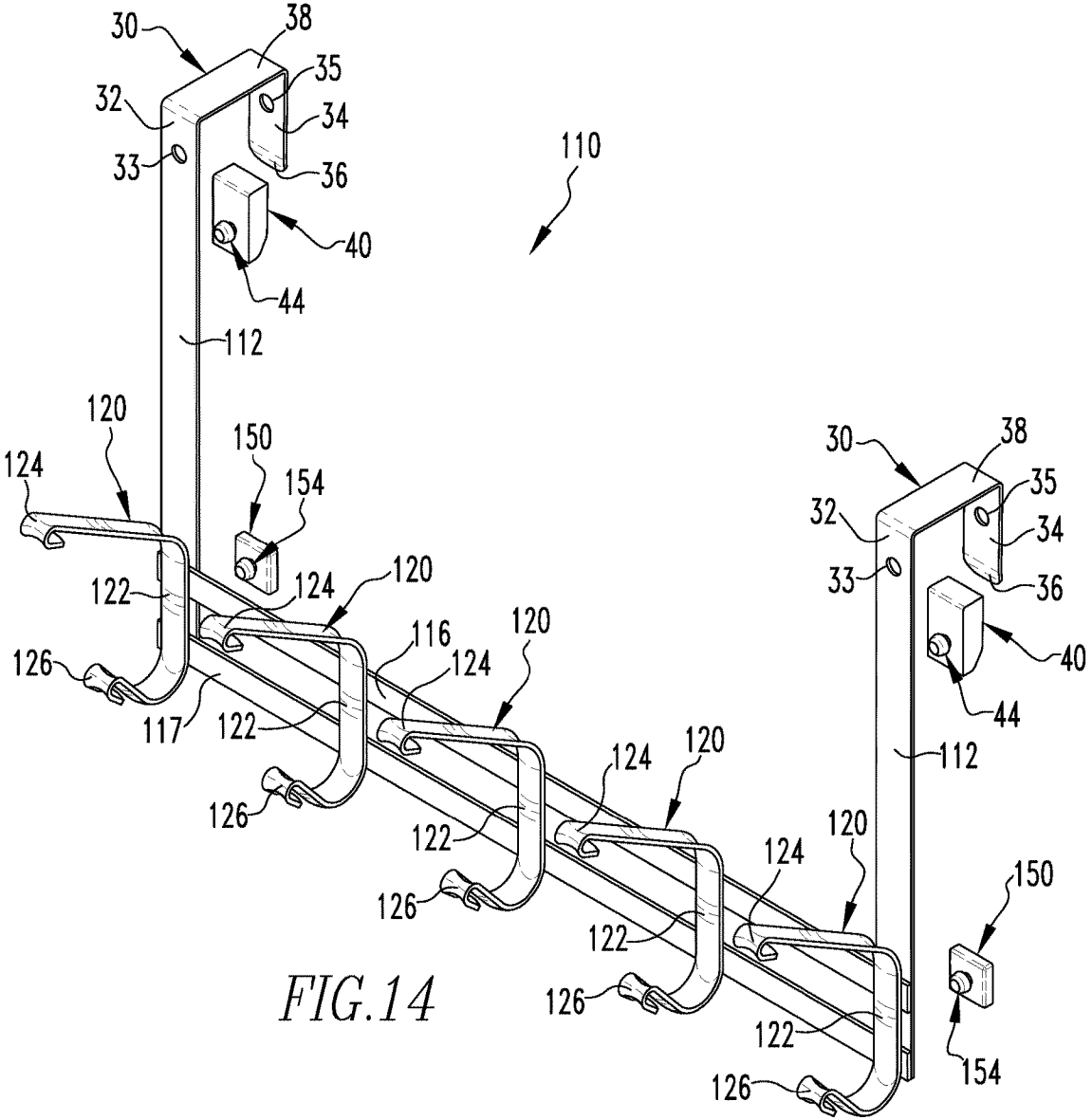
FIG. 14 is a front isometric exploded view of an adjustable over-the-door hook assembly in accordance with another embodiment of the present invention.

FIG. 14 illustrates an adjustable over-the-door hook assembly 110 in accordance with another embodiment of the present invention. The over-the-door hook assembly 110 includes adjustable support brackets 30 and door spacers 40 similar to those described in the embodiment above. The mounting pin 44 of each door spacer 40 may be inserted through either the front spacer mounting hole 33 in the front vertical plate 32, or through the rear spacer mounting hole 35 in the rear vertical plate 34 in a similar manner as described above.

The adjustable over-the-door hook assembly 110 shown in FIG. 14 includes two vertical support rods 112 in the form of flat bars that are integrally formed with the adjustable support brackets 30. Upper and lower lateral support rods 116 and 117 in the form of flat bars extend between the lower ends of the vertical support rods 112. Multiple hooks 120 are attached to the upper and lower lateral support rods 116 and 117. Each hook 120 includes a back support portion 122 fastened to the upper and lower lateral support rods 116 and 117, an upper hook portion 124, and a lower hook portion 126. Although five hooks 120 are shown in the embodiment of FIG. 14, it is to be understood that any other suitable number of hooks may be used, e.g., one, two, three, four, six or more.

Figure 15:
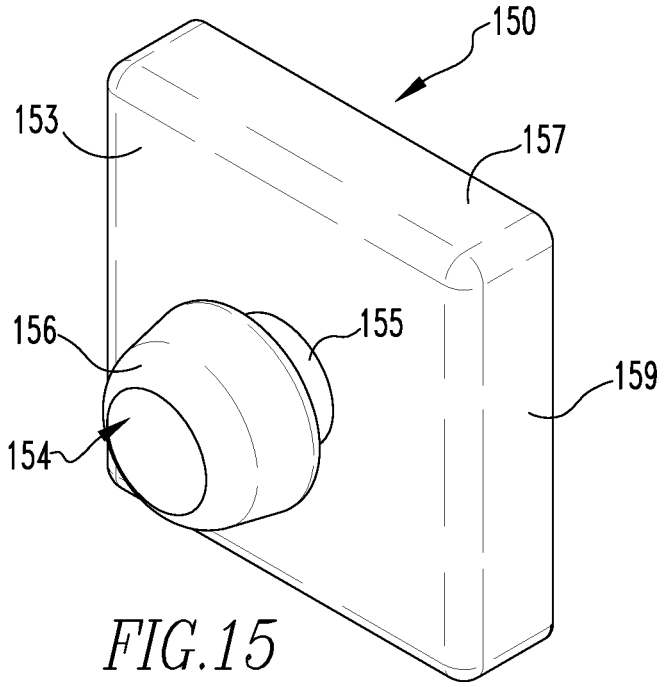
FIG. 15 is a rear isometric view of a door bumper for use in an adjustable over-the-door hook assembly in accordance with an embodiment of the present invention.
Figure 16:
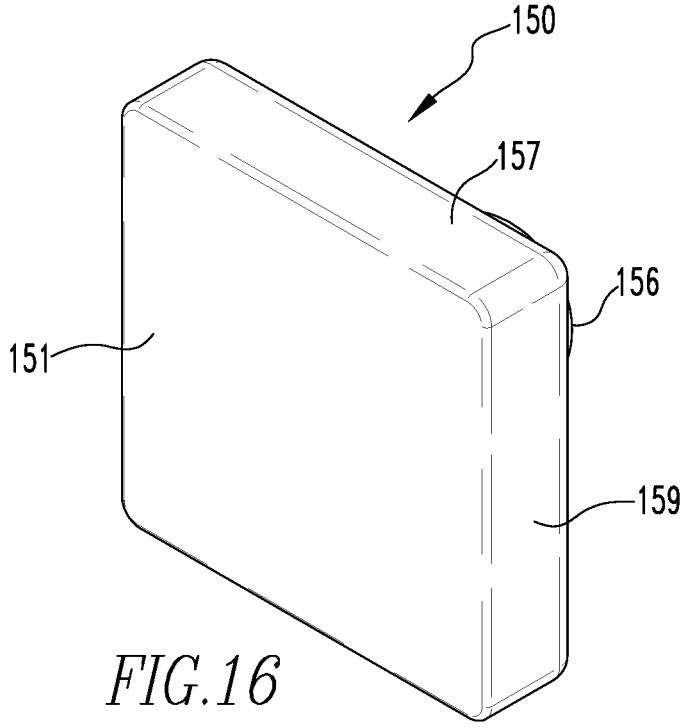
FIG. 16 is a front isometric view of the door bumper of FIG. 15.

As further shown in FIGS. 14-16, the adjustable over-the-door hook assembly 110 includes door bumpers 150 removably mountable at the lower ends of the vertical support rods 112. In the embodiment shown, each door bumper 150 includes a mounting pin 154 that may be inserted through a hole (not shown) extending through the lower end of each vertical support rod 112. As shown most clearly in FIGS. 15 and 16, the door bumper 150 includes a vertical door contact surface 151 and an opposing support rod contact surface 153. In the embodiment shown, the contact surfaces 151 and 153 are substantially planar. However, any other suitable contact surface shape may be used. The door bumper 150 also includes a mounting pin 154 including a generally cylindrical shaft 155 and a retaining head 156 having a greater diameter than the shaft 155.

Figure 17:
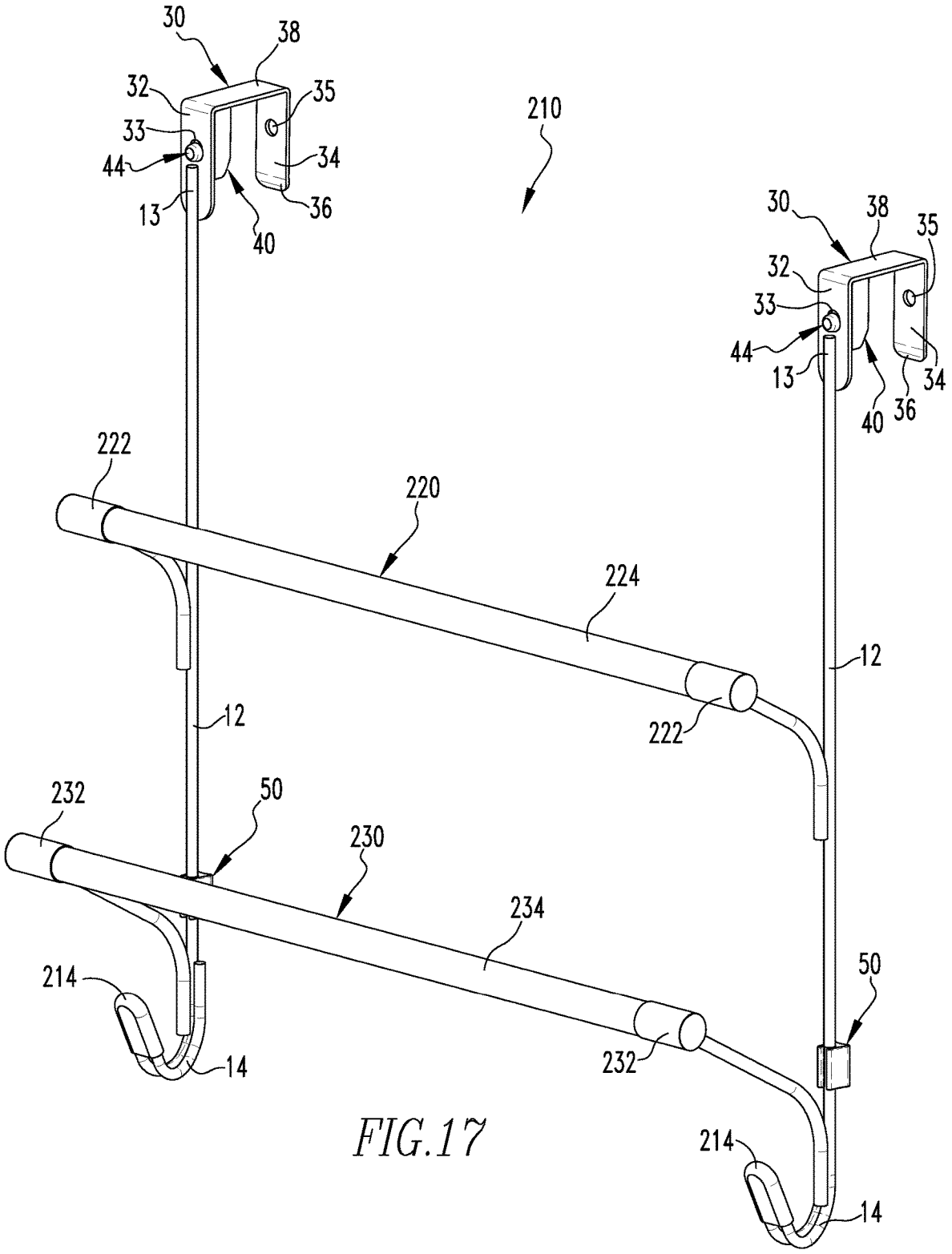
FIG. 17 is a front isometric view of an adjustable over-the-door hook assembly in accordance with a further embodiment of the present invention.

FIG. 17 illustrates an adjustable over-the-door hook assembly 210 in the form of a rack in accordance with another embodiment of the present invention. The adjustable over-the-door hook assembly 210 includes vertical support rods 12, adjustable support brackets 30, and door spacers 40 similar to those described in the embodiment of FIGS. 1-13. Each door bumper 150 includes a top surface 157 and side surfaces 159. The over-the-door hook assembly 210 includes door bumpers 50 releasably attached to the vertical support rods 12 similar to those described in the embodiment of FIGS. 1-13. In the embodiment shown in FIG. 17, each vertical support rod 12 has a lower end 14 which transitions into an upwardly extending hook 214. Upper and lower racks 220 and 230 are secured to the vertical support rods 12. The upper rack 220 includes upper brackets 222 that hold an upper rod 224 therebetween. The lower rack 230 includes lower brackets 232 that hold a lower rod 234 therebetween. Although the over-the-door hook assembly 210 shown in FIG. 17 includes two horizontal rods 220 and 230, it is to be understood that any other suitable number of rods may be used, e.g., one, three, four or more. Furthermore, although two hooks 214 are shown in the embodiment of FIG. 17, it is to be understood that the over-the-door hook assembly 210 may not include any such hooks, or may include one, three, four or more hooks. Thus, the adjustable over-the-door hook assemblies of the present invention may include hooks and/or rods in any desired numbers and combinations.

As used herein, "including," "containing" and like terms are understood in the context of this application to be synonymous with "comprising" and are therefore open-ended and do not exclude the presence of additional undescribed or unrecited elements, materials, phases or method steps. As used herein, "consisting of" is understood in the context of this application to exclude the presence of any unspecified element, material, phase or method step. As used herein, "consisting essentially of" is understood in the context of this application to include the specified elements, materials, phases, or method steps, where applicable, and to also include any unspecified elements, materials, phases, or method steps that do not materially affect the basic or novel characteristics of the invention.

In this application, the use of the singular includes the plural and plural encompasses singular, unless specifically stated otherwise. In addition, in this application, the use of "or" means "and/or" unless specifically stated otherwise, even though "and/or" may be explicitly used in certain instances. In this application and the appended claims, the articles "a," "an," and "the" include plural referents unless expressly and unequivocally limited to one referent.

Whereas particular embodiments of this invention have been described above for purposes of illustration, it will be evident to those skilled in the art that numerous variations of the details of the present invention may be made without departing from the invention as defined in the appended claims.

What is claimed is:

1. An adjustable over-the-door hook assembly comprising:

at least one adjustable support bracket structured and arranged for placement over a top edge of a door comprising front and rear vertical plates having opposing interior surfaces, and an upper horizontal plate connecting the front and rear vertical plates;

at least one vertical support rod attached to the at least one adjustable support bracket;

at least one hook or rod supported by the at least one vertical support rod; and a removable door spacer selectively attachable adjacent to the interior surface of the front vertical plate and selectively attachable to the interior surface of the rear vertical plate, wherein the door spacer comprises a vertical door contact surface and an opposing bracket contact surface having a mounting pin extending therefrom structured and arranged to extend through a front hole extending through the front vertical plate and to alternatively extend through a rear hole extending through the rear vertical plate to thereby selectively attach the door spacer to either the front vertical plate or the rear vertical plate of the adjustable support bracket.

2. The adjustable over-the-door book assembly of claim 1, wherein the mounting pin comprises a shaft and a head connected to the shaft having a larger diameter than a diameter of the shaft.

3. The adjustable over-the-door hook assembly of claim 1, wherein the door spacer has a thickness measured between a bracket contact surface of the door spacer and the door contact surface of from 0.3 to 0.5 inch, and the door spacer is made of a compressible elastic material.

4. An adjustable over-the-door hook assembly comprising:

at least one adjustable support bracket structured and arranged for placement over a top edge of a door comprising front and rear vertical plates having opposing interior surfaces, and an upper horizontal plate connecting the front and rear vertical plates;

at least one vertical support rod attached to the at least one adjustable support bracket;

at least one hook or rod supported by the at least one vertical support rod;

a removable door spacer selectively attachable adjacent to either the interior surface of the front vertical plate or the interior surface of the rear vertical plate, wherein the front vertical plate of the support bracket has a front hole extending therethrough, the rear vertical plate of the support bracket has a rear hole extending therethrough, the door spacer has a mounting pin extending from a bracket contact surface of the door spacer, and the mounting pin is selectively engagable within either the front hole or the rear hole to thereby releasably attach the door spacer to either the front vertical plate or the rear vertical plate.

5. An adjustable over-the-door hook assembly comprising:

at least one adjustable support bracket structured and arranged for placement over a top edge of a door comprising front and rear vertical plates having opposing interior surfaces, and an upper horizontal plate connecting the front and rear vertical plates;

at least one vertical support rod attached to the at least one adjustable support bracket;

at least one book or rod supported by the at least one vertical support rod;

a removable door spacer selectively attachable adjacent to either the interior surface of the front vertical plate or the interior surface of the rear vertical plate, wherein the door spacer comprises a substantially vertical door contact surface, and an inwardly angled lower portion adjacent to the substantially vertical door contact surface.

* * * * *